US010415148B2

(12) United States Patent
Mertens et al.

(10) Patent No.: US 10,415,148 B2
(45) Date of Patent: Sep. 17, 2019

(54) PASSIVATION OF MICRO-DISCONTINUOUS CHROMIUM DEPOSITED FROM A TRIVALENT ELECTROLYTE

(71) Applicant: MacDermid Acumen, Inc., Waterbury, CT (US)

(72) Inventors: Marc Mertens, Oss (NL); Richard Tooth, West Midlands (GB); Trevor Pearson, West Midlands (GB); Roderick D. Herdman, Staffordshire (GB); Terence Clarke, Wolverhampton (GB)

(73) Assignee: MacDermid Acumen, Inc., Waterbury, CT (US)

( * ) Notice: Subject to any disclaimer, the term of this patent is extended or adjusted under 35 U.S.C. 154(b) by 689 days.

(21) Appl. No.: 14/200,546

(22) Filed: Mar. 7, 2014

(65) Prior Publication Data

US 2015/0252487 A1 Sep. 10, 2015

(51) Int. Cl.

| | |
|---|---|
| ***C25D 11/38*** | (2006.01) |
| ***C25D 3/06*** | (2006.01) |
| ***C25D 9/08*** | (2006.01) |
| ***C25D 5/48*** | (2006.01) |

(52) U.S. Cl.

CPC ..... *C25D 3/06* (2013.01); *C25D 5/48* (2013.01); *C25D 9/08* (2013.01); *Y10T 428/12854* (2015.01)

(58) Field of Classification Search

CPC ..... C25D 3/06; C25D 3/10; C25D 11/38
USPC ..... 205/287, 289, 290, 319
See application file for complete search history.

(56) References Cited

U.S. PATENT DOCUMENTS

| | | | | |
|---|---|---|---|---|
| 3,006,823 A | | 10/1961 | Deyrup | |
| 3,706,636 A | | 12/1972 | Bride | |
| 4,007,099 A | | 2/1977 | Wu | |
| 4,053,374 A | | 10/1977 | Crowther | |
| 4,137,132 A | | 1/1979 | Ward et al. | |
| 4,142,948 A | * | 3/1979 | Tajima | C25D 3/56 205/243 |
| 4,169,022 A | | 9/1979 | Ward et al. | |
| 4,617,095 A | | 10/1986 | Tomaszewski | |
| 4,875,983 A | | 10/1989 | Alota et al. | |
| 6,004,448 A | * | 12/1999 | Martyak | C25D 9/08 205/178 |

(Continued)

FOREIGN PATENT DOCUMENTS

| | | | | |
|---|---|---|---|---|
| EP | 2492372 A1 | * | 8/2012 | C23C 22/34 |
| JP | 2009-235456 A | † | 10/2009 | |

(Continued)

*Primary Examiner* — Edna Wong
(74) *Attorney, Agent, or Firm* — Carmody Torrance Sandak & Hennessey LLP

(57) ABSTRACT

A method of treating a substrate, wherein the substrate comprises a layer deposited from a trivalent chromium electrolyte, is described. The method includes the steps of providing an anode and the chromium(III) plated substrate as a cathode in an electrolyte comprising (i) a trivalent chromium salt; and (ii) a complexant; and passing an electrical current between the anode and the cathode to passivate the chromium(III) plated substrate. The substrate may be first plated with a plated nickel layer so that the chromium(III) plated layer is deposited over the nickel plated layer.

15 Claims, 5 Drawing Sheets

(56) References Cited

U.S. PATENT DOCUMENTS

| | | | | |
|---|---|---|---|---|
| 7,780,840 | B2 | 8/2010 | Pearson et al. | |
| 2009/0211914 | A1 | 8/2009 | Huang et al. | |
| 2010/0243463 | A1* | 9/2010 | Herdman | C25D 3/06 205/180 |
| 2011/0117380 | A1 | 5/2011 | Sugawara et al. | |
| 2012/0024714 | A1* | 2/2012 | Kwon | C25D 3/06 205/287 |

FOREIGN PATENT DOCUMENTS

| | | | | |
|---|---|---|---|---|
| JP | 2010-209456 | A † | 9/2010 | |
| SU | 1682412 | A1 * | 10/1991 | C25D 11/38 |
| WO | 2011/127473 | | 10/2011 | |
| WO | WO 2011147447 | A1 * | 12/2011 | C23C 22/362 |

* cited by examiner
† cited by third party

PASSIVATION OF MICRO-DISCONTINUOUS CHROMIUM DEPOSITED FROM A TRIVALENT ELECTROLYTE

FIELD OF THE INVENTION

The present invention relates generally to a method of imparting improved corrosion protection to chromium plated substrates, which have been plated with chromium from a $Cr^{+3}$ plating bath.

BACKGROUND OF THE INVENTION

A variety of compositions and processes have been used or suggested for use in order to impart improved corrosion resistance to chromium plated substrates to prevent the formation of rust spots when exposed to a corrosive environment. The use of nickel/chromium electrodeposits on a metal or plastic substrate to provide a decorative and corrosion resistant finish is also well known.

Traditionally, the nickel underlayer is deposited electrolytically from an electrolyte based on nickel sulfate or nickel chloride, and boric acid. This electrolyte also typically contains organic additives to make the deposit brighter and harder and also to confer leveling (i.e., scratch hiding) properties. The organic additives also control the electrochemical activity of the deposit and often duplex nickel deposits are applied where the layer closest to the substrate is more noble than the bright nickel deposited on top of it. This improves the overall corrosion performance as it delays the time required for penetration to the substrate by the corrosive environment. Typically, the total thickness of the nickel electrodeposited layer is between about 5 and about 30 micrometers in thickness.

Following the application of the nickel underlayer, a thin deposit of chromium (typically about 300 nm in thickness) is applied from a solution of chromic acid containing various catalytic anions such as sulfate, fluoride, and methane disulfonate. The chromium metal deposited by this method is very hard and wear resistant and is electrochemically very passive due to the formation of an oxide layer on the surface. Because the chromium deposit is very thin, it tends to have discontinuities through which the underlying nickel is exposed. This leads to the formation of an electrochemical cell in which the chromium deposit is the cathode and the underlying nickel layer is the anode and thus corrodes. In order to ensure even corrosion of the underlying nickel, a deposit of microporous or microcracked nickel is often applied prior to chromium plating. Thus, in the presence of a corrosive environment, the nickel will corrode preferentially to the chromium. One such process is described, for example in U.S. Pat. No. 4,617,095 to Tomaszewski et al., the subject matter of which is herein incorporated by reference in its entirety.

The half-equations of the corrosion reaction can be summarized as follows:

At the anode:

$$Ni \rightarrow Ni^{2+} + 2e^-$$

At the cathode:

$$2H_2O + 2\ e^- \rightarrow H_2 + 2\ OH^-$$

The net result is that the pores through which the corrosion occurs tend to accumulate deposits of nickel hydroxide, which detract from the appearance of the deposit. It can also be seen from the cathodic reaction that hydrogen is liberated. Electrodeposited chromium as produced from a chromic acid electrolyte is a very poor substrate for hydrogen liberation and thus the cathodic reaction is kinetically inhibited and is very slow. This means that the corrosion reaction is also very slow, which leads to an excellent corrosion performance.

A further advantage of using chromic acid based electrolytes is that exposed substrate metal which is not covered by chromium in the plating process (such as steel on the inside of tubes and exposed steel through pores in the nickel deposit or even exposed nickel pores under the discontinuous chromium layer) is passivated by the strongly oxidizing nature of the chromic acid. This further reduces the rate of corrosion.

However, chromic acid is extremely corrosive and toxic. It is also a carcinogen, a mutagen and is classified as reprotoxic. Because of this, the use of chromic acid is becoming more and more problematic. Tightening legislation is making it very difficult to justify the use of chromic acid in a commercial environment.

Chromium plating processes based on the use of trivalent chromium salts have been available since the mid-1970s and these processes have been refined over the years so that they are reliable and produce decorative chromium deposits. However, these chromium deposits do not behave the same in terms of their electrochemical properties as those deposited from a chromic acid solution.

The chromium deposited from a trivalent electrolyte is less pure than that deposited from a chromic acid solution and so is effectively an alloy of chromium. Depending on the electrolyte from which the chromium is produced, co-deposited materials may include carbon, nitrogen, iron and sulfur. These co-deposited materials have the effect of depolarizing the cathode reaction, thus increasing the rate of the electrochemical corrosion reaction and reducing the corrosion resistance of the coating. In addition, because the trivalent chromium electrolytes are not as strongly oxidizing in nature as hexavalent chromium solutions, they do not passivate any exposed substrate material, having a further deleterious effect on the corrosion performance. Thus, there remains a need in the art for a method of passivating exposed substrates that is also able to decrease the rate of the cathodic reaction during galvanic corrosion of the nickel chromium deposit.

Several attempts have been made to try to solve this problem. For example, U.S. Pat. Pub. No. 2011/0117380 to Sugawara et al., the subject matter of which is herein incorporated by reference in its entirety, describes the use of an acid solution containing dichromate ions used cathodically to deposit a passive layer onto chromium deposits from a trivalent electrolyte. However, this process does not avoid the use of toxic hexavalent chromium and actually introduces a small amount of hexavalent chromium onto the surface of the treated components.

SUMMARY OF THE INVENTION

It is an object of the present invention to provide improved corrosion protection to chromium(III) plated substrates.

It is another object of the present invention to improve the corrosion resistance of a chromium(III) plated article having an underlying nickel layer.

To that end, in one embodiment, the present invention relates generally to a method of treating a substrate, wherein the substrate comprises a plated layer deposited from a trivalent chromium electrolyte, the method comprising the steps of:

(a) providing an anode and the plated substrate as a cathode in an electrolyte comprising (i) a trivalent chromium salt; and (ii) a complexant;

(b) passing an electrical current between the anode and the cathode to deposit a passivate film on the chromium(III) plated substrate.

DETAILED DESCRIPTION OF THE PREFERRED EMBODIMENTS

Figure 1:
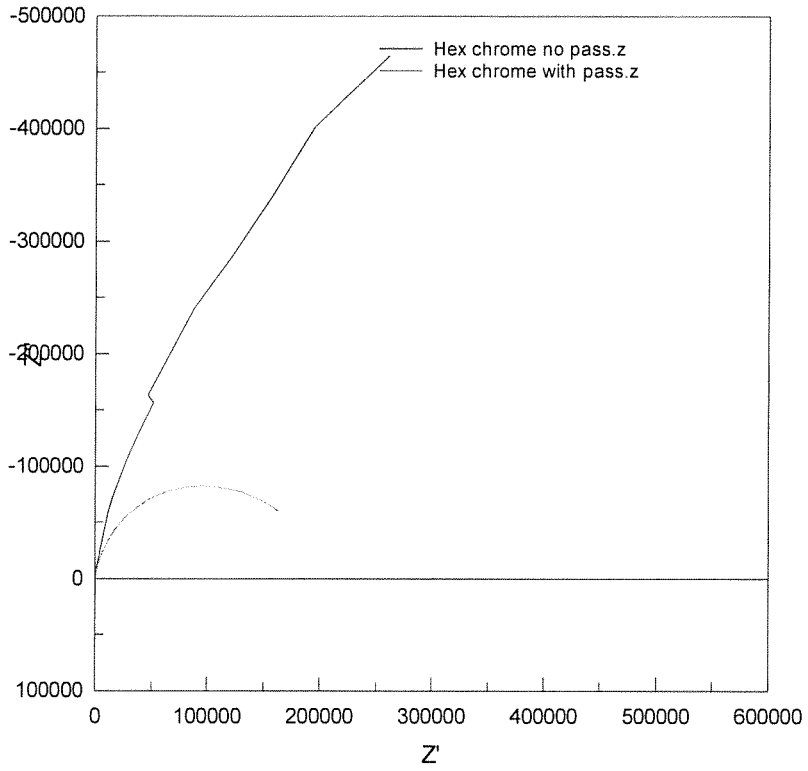
FIG. 1 depicts a Nyquist plot obtained from the results of Comparative Example 1.

The present invention relates generally to a method of providing improved corrosion protection to trivalent chromium plated substrates. In one embodiment, the present invention is used to improve the corrosion resistance of trivalent chromium plated articles having a nickel plating layer underlying the chromium plated layer. Thus, the present invention may be used to improve the corrosion resistance of nickel plated substrates having a chromium layer deposited from a trivalent chromium electrolyte thereon.

The inventors of the present invention have discovered a remarkable and unexpected synergy between chromium alloy coatings produced from trivalent electrolytes and the coatings produced by treating such chromium alloy plated items cathodically in a solution containing trivalent chromium salts and a suitable complexant.

The present invention comprises a method of processing components plated with a chromium alloy deposit in a solution comprising a trivalent chromium salt and a complexant.

More specifically, in one embodiment, the present invention relates generally to a method of treating a substrate, wherein the substrate comprises a plated layer deposited from a trivalent chromium electrolyte, the method comprising the steps of:

(a) providing an anode and the substrate as a cathode in an electrolyte comprising (i) a trivalent chromium salt; and (ii) a complexant;

(b) passing an electrical current between the anode and the cathode to deposit a passivate film on the substrate.

As described herein, in one preferred embodiment the substrate is first plated with a nickel plating layer and the plated layer is deposited using a trivalent chromium electrolyte, over the nickel plated layer.

The electrolyte solution typically comprises between about 0.01 and about 0.5 M, more preferably between about 0.02 and about 0.2 M of the chromium(III) salt. The trivalent chromium salt is preferably selected from the group consisting of chromium sulfate, basic chromium sulfate (chrometan), and chromium chloride, although other similar chromium salts may also be used in the practice of the invention. The complexant is preferably a hydroxy organic acid, including, for example, malic acid, citric acid, tartaric acid, glycolic acid, lactic acid, gluconic acid, and salts of any of the foregoing. More preferably, the hydroxy organic acid is selected from the group consisting of malic acid, tartaric acid, lactic acid and gluconic acid and salts thereof.

The chromium salt and the complexant are preferably present in the solution at a molar ratio of between about 0.3:1 to about 0.7:1.

The solution may also optionally include conductivity salts, including, for example, sodium chloride, potassium chloride, sodium sulfate and potassium sulfate, by way of example and not limitation.

The substrates to be processed are immersed in the passivate solution preferably at a temperature of between about 10 and about 40° C. and a pH of between about 2 and about 5 and most preferably at about 3.5. The substrates are made cathodic at a current density of between about 0.1 and about 2 $A/dm^2$ for a period of time between about 20 seconds and about 5 minutes, more preferably for about 40 to about 240 seconds. Following this, the components are rinsed and dried. This treatment produces a remarkable improvement in the corrosion performance of the plated components.

The process described herein works by depositing a thin layer of hydrated chromium compounds on the surface of the components. Making the components cathodic in an electrolyte of moderate pH liberates hydrogen ions at the surface which rapidly leads to a local increase in pH. This in turn leads to the precipitation of basic chromium compounds at the surface.

In another embodiment, the present invention relates generally to a substrate comprising a plated layer deposited from a trivalent chromium electrolyte passivated according to the process described herein, wherein the passivated chromium(III) plated layer exhibits a polarization resistance of at least about $4.0\times10^5$ $\Omega/cm^2$, more preferably a polarization resistance of at least about $8.0\times10^5$ $\Omega/cm^2$, and most preferably a polarization resistance of at least about $9.0\times10^5$ $\Omega/cm^2$.

The exact nature of the coating is not known, but examination by X-ray photo-electron spectroscopy (XPS) reveals the presence of trivalent chromium and oxygen. It is well known that chromium(III) ions can form polymeric species at high pH (by a process known as "olation") and it is likely that it is these compounds that form the passivate layer because chromium(III) hydroxide forms a flocculent precipitate that is adherent to surfaces.

The inventors have found that the best results are obtained using chrometan as a source of chromium ions and sodium gluconate as the complexant. The inventors have also found that above a concentration of about 0.5 M, the coating produced is dark in color and detracts from the visual appearance of the component. Regarding the complexant, above a ratio of about 0.7:1 complexant to chromium, the chromium is too strongly complexed and the corrosion performance is compromised. Below a ratio of about 0.3:1, the chromium tends to precipitate from solution. The inventors have also found that a pH of about 3.5 is optimum for the process. Below a pH of about 2.0, the hydrogen ion concentration is too high for the pH to increase sufficiently to form the coating and no protective film is formed. Above a pH of about 5, chromium ions tend to precipitate from solution as chromium(III) hydroxide. The temperature of the process solution is not critical. However, temperatures above about 40° C. require a much higher current density in order to produce a coating. This is probably due to the increased rates of hydrogen ion diffusion at the higher temperature.

The inventors have found that the optimum current density is in the range of about 0.5 to 1.0 A/dm$^2$. Below this value, there is insufficient pH rise to form the coating effectively and above this value, the coatings tend to become too thin because of high scrubbing/agitation of released hydrogen that detracts from the visual appearance of the coatings. At the optimum current density, the preferred processing time is about 40 to about 240 seconds. Shorter times produce thinner coatings so that the corrosion performance is not optimum and longer times tend to produce coatings that darken the visual appearance of the processed components.

The present invention will now be illustrated by reference to the following non-limiting examples:

Comparative Example 1

Four steel panels were plated with 5 microns of bright nickel solution and 0.3 microns of chromium deposited from a solution containing 250 g/L of chromic acid and 2.5 g/L of sulfate ions. The low thickness of nickel was chosen so that there would be some porosity and exposure of the underlying steel substrate. This type of plating quickly shows substrate corrosion.

Two of the panels were left untreated and two of the panels were coated with a passivate of the invention described above having the following composition:

Chrometan 10 g/L (giving a chromium concentration of 1.8 g/L or 0.03 M)

Sodium gluconate 3.8 g/L (giving a molar concentration of 0.017 M)

Sodium hydroxide to adjust the pH to 3.5

The coating process was carried out at a temperature of 25° C. and an average current density of 0.5 A/dm2 for 120 seconds. The panels were then rinsed and dried. The corrosion performance of the panels was evaluated in a 5% sodium chloride solution by electrochemical impedance spectroscopy (EIS) using an EG&G model 263A potentiostat and a Solartron frequency response analyzer (FRA). This technique can be used to measure the polarization resistance of the test panel which is in turn related to the overall rate of corrosion of the surface, the higher the polarization resistance, the more corrosion resistant the coating.

Figure 2:
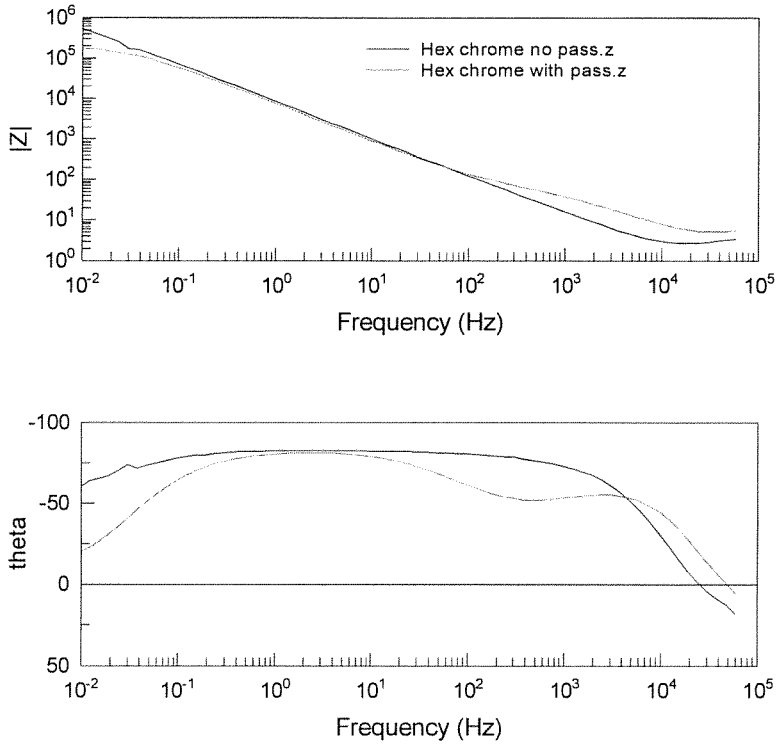
FIG. 2 depicts a Bode plot obtained from the results of Comparative Example 1.

In order to determine this value, a frequency scan was carried out from 60,000 Hz to 0.01 Hz at the corrosion potential +/−10 mV. The polarization resistance was determined by plotting the real impedance versus the imaginary impedance at every point on the frequency scan. This is called a Nyquist plot and for a normal charge transfer process yields a semicircular plot from which the polarization resistance can be calculated. Plots of frequency versus impedance and frequency versus phase angle were also plotted (these are called Bode plots and can generate more detailed information about the nature of the corrosion process). FIGS. 1 and 2 show the Nyquist and Bode plots obtained from an average of 5 results from each of the panels.

It can be seen from the Nyquist plot that the semi-circle formed from the unpassivated panel is much larger that than from the passivated panel. Calculation of the polarization resistance in each case gives a value of $9.2\times10^5$ Ω/cm$^2$ for the unpassivated panel and $2.9\times10^5$ Ω/cm2 for the passivated panel. Thus, the corrosion resistance is less for the passivated panel than the unpassivated panel by a factor of about 3. The bode plot of frequency versus phase angle clearly shows the effect of passivation. The red line shows 2 time constants for the passivated panel and just one for the unpassivated panel. This clearly indicates formation of a coating.

Example 1

Test panels were prepared in the same manner as in Comparative Example 1 except that the chromium coating was applied from a trivalent electrolyte (Trimac III, available from MacDermid, Inc.). This produces a chromium coating containing up to 2% sulfur and also having up to 0.5% carbon codeposited with the chromium, effectively making it an alloy. Again, two panels were left unpassivated and two were passivated using the same process as described in Comparative Example 1. Again, EIS was used to examine the panels to determine the polarization resistance.

Figure 3:
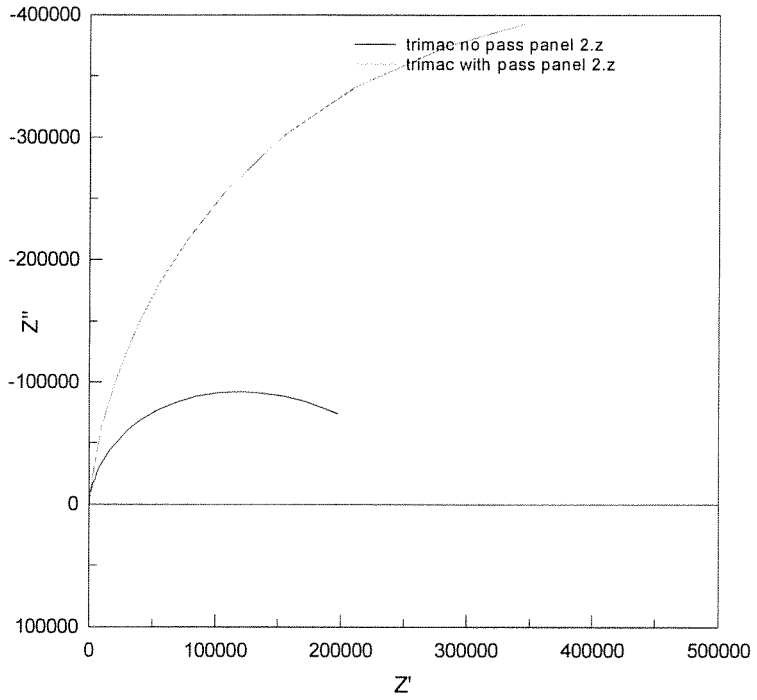
FIG. 3 depicts a Nyquist plot obtained from the results of Example 1.
Figure 4:
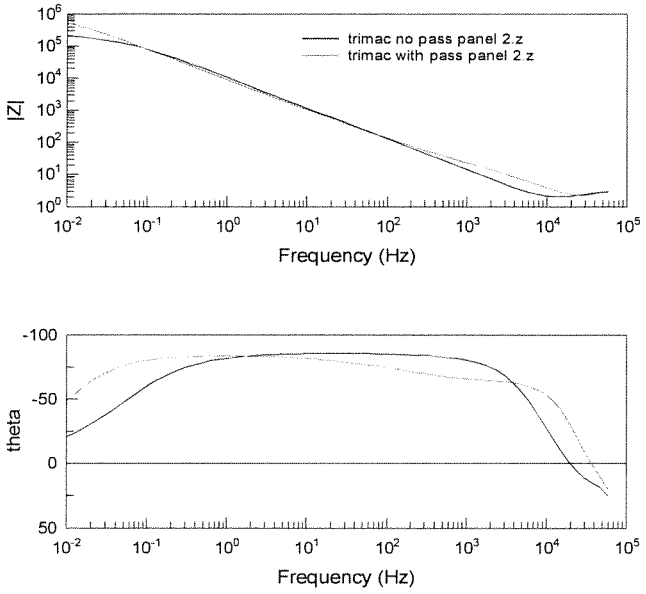
FIG. 4 depicts a Bode plot obtained from the results of Example 1.

The results of these tests are shown in FIGS. 3 and 4 (Nyquist and Bode plots).

Here, it can be seen that the situation is reversed and that the passivated panel has the higher polarization resistance. This is supported by the bode plot which again shows the two time constants for the passivated panel and only one for the unpassivated panel. In this case, the calculated values of the polarization resistance are $1.8\times10^5$ Ω/cm$^2$ for the unpassivated panel and $8.8\times10^5$ Ω/cm$^2$ for the passivated panel. This represents an improvement in corrosion resistance of a factor of about 4.

Example 2

Test panels were prepared in the same manner as in Comparative Example 1 except that the chromium coating was applied from a trivalent electrolyte (Trimac III, available from MacDermid, Inc.). One of the panels was left unpassivated, one was cathodically passivated in a solution of potassium dichromate and one was passivated using the process solution as described in Comparative Example 1.

Figure 5:
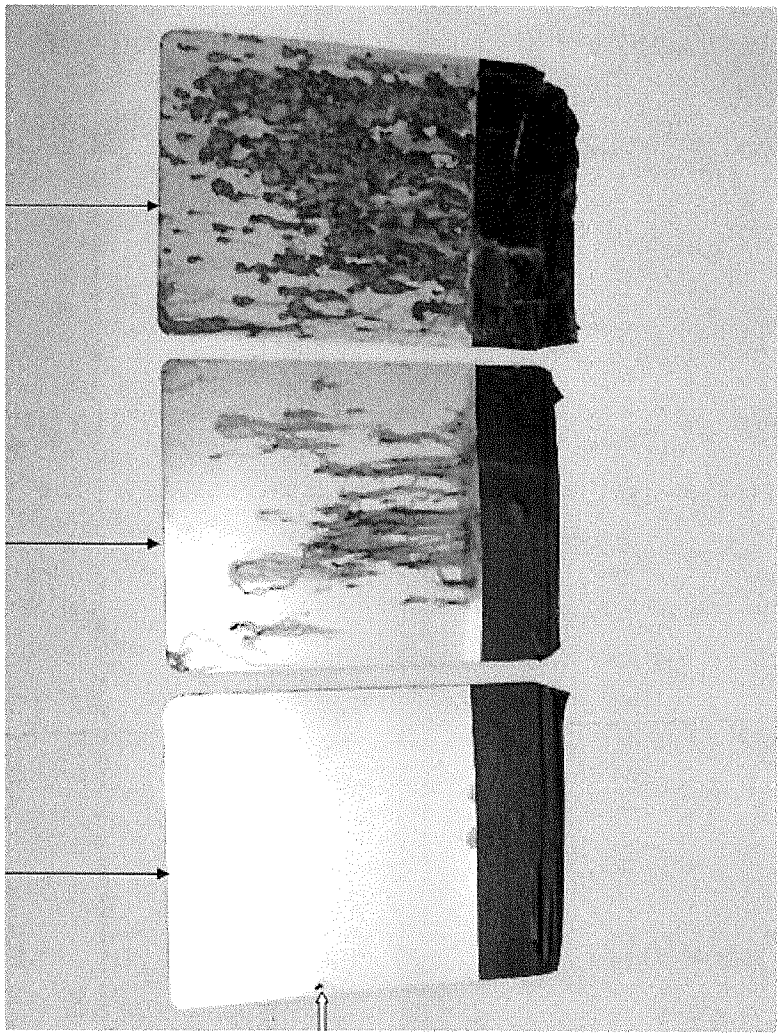
FIG. 5 depicts a comparison of the corrosion of an unpassivated panel, a panel passivated with hexavalent chromium and a panel passivated with the trivalent chromium electrolyte of this invention.

The panels were exposed to a neutral salt spray accelerated corrosion test (ASTM B117) for 72 hours and the results were compared as shown in FIG. 5. As seen in FIG. 5, the unpassivated panel (left panel) showed major red rust corrosion and some red rust was also evident on the panel passivated in hexavalent chromium (center panel). By comparison, there was no corrosion evident on the panel passivated in accordance with the compositions described herein.

What is claimed is:

1. A method of treating a substrate to provide improved corrosion protection thereof, wherein the substrate comprises a plated nickel layer and a chromium (III) plated layer, deposited above the nickel plated layer, from a trivalent chromium electrolyte, the method comprising the steps of:

(a) providing an anode and the substrate comprising the chromium (III) plated layer as a cathode in a passivate solution comprising (i) a trivalent chromium salt; and (ii) a complexant; and (iii) a pH adjuster to adjust pH to between 2 and 5; and (b) passing an electrical current between the anode and the cathode to deposit a passivate film over the chromium (III) plated layer on the substrate, said passivate film comprising hydrated chromium compounds;

wherein the electrical current is between about 0.1 and about 2.0 A/dm$^2$;

wherein the molar ratio of chromium salt to complexant is from 0.3:1 to 0.7:1 based on chromium content; and wherein the substrate after steps (a) and (b) has a polarization resistance of at least $4.0\times10^5$ Ω/cm$^2$.

2. The method according to claim 1, wherein the trivalent chromium salt is selected from the group consisting of chromium sulfate, basic chromium sulfate, chromium chloride, and combinations of one or more of the foregoing.

3. The method according to claim 2, wherein the trivalent chromium salt is basic chromium sulfate.

4. The method according to claim 1, wherein the passivate solution comprises between about 0.01M and about 0.5M of the trivalent chromium salt.

5. The method according to claim 4, wherein the passivate solution comprises between about 0.02M and about 0.2M of the trivalent chromium salt.

6. The method according to claim 1, wherein the complexant is a hydroxy organic acid.

7. The method according to claim 6, wherein the hydroxy organic acid is selected from the group consisting of malic acid, citric acid, tartaric acid, glycolic acid, lactic acid, gluconic acid and salts of any of the foregoing.

8. The method according to claim 7, wherein the hydroxy organic acid is selected from the group consisting of malic acid, tartaric acid, lactic acid and gluconic acid and salts of any of the foregoing.

9. The method according to claim 1 wherein the passivate solution further comprises a conductivity salt.

10. The method according to claim 9, wherein the conductivity salt is selected from the group consisting of sodium chloride, potassium chloride, sodium sulfate, potassium sulfate, and combinations of one or more of the foregoing.

11. The method according to claim 1, wherein the passivate solution is maintained at a temperature of between about 20 and about 40 degrees C.

12. The method according to claim 1 wherein the substrate is contacted with the passivate solution for between about 20 seconds and 5 minutes.

13. The method according to claim 12, wherein the substrate is contacted with the passivate solution for between about 40 and about 240 seconds.

14. The method according to claim 1, wherein the electrical current is between about 0.5 and about 1.0 $A/dm^2$.

15. The method according to claim 1, wherein the pH of the passivate solution is about 3.5.

* * * * *